US005898412A

United States Patent [19]

Jones et al.

[11] Patent Number: 5,898,412

[45] Date of Patent: Apr. 27, 1999

[54] TRANSMIT/RECEIVE ANTENNA MOUNTING ENCLOSURE

[75] Inventors: Clifford T. Jones, Raleigh; Thomas W. Ruckdeschel, Apex, both of N.C.

[73] Assignee: Ericsson Inc., Research TrianglePark, N.C.

[21] Appl. No.: 08/691,457

[22] Filed: Aug. 2, 1996

[51] Int. Cl.[6] ..... H01Q 1/42; H01Q 1/12

[52] U.S. Cl. ..... 343/872; 343/878

[58] Field of Search ..... 343/872, 873, 343/853, 878, 720; H01Q 1/42, 1/50

[56] References Cited

U.S. PATENT DOCUMENTS

| | | | |
|---|---|---|---|
| D. 238,581 | 1/1976 | Lehmann | D26/5 R |
| D. 252,568 | 8/1979 | Comstock | D13/40 |
| D. 265,986 | 8/1982 | Wearsch et al. | D13/13 |
| D. 266,662 | 10/1982 | Brownell et al. | D13/13 |
| D. 312,244 | 11/1990 | Collins et al. | D13/152 |
| D. 317,908 | 7/1991 | Channell | D13/184 |
| D. 336,074 | 6/1993 | Friend et al. | D13/184 |
| 4,403,106 | 9/1983 | Lask et al. | 174/59 |
| 4,419,537 | 12/1983 | Leep et al. | 174/65 R |
| 4,661,821 | 4/1987 | Smith | 343/743 |
| 5,019,829 | 5/1991 | Heckman et al. | 343/853 |
| 5,132,648 | 7/1992 | Trinh et al. | 343/853 |
| 5,276,455 | 1/1994 | Fitzsimmons et al. | 343/853 |
| 5,423,072 | 6/1995 | Iwashita et al. | 343/872 |
| 5,459,474 | 10/1995 | Mattioli et al. | 343/702 |
| 5,619,217 | 4/1997 | Mailandt et al. | 343/872 |

FOREIGN PATENT DOCUMENTS

| | | |
|---|---|---|
| 0 395 493 | 10/1990 | European Pat. Off. . |
| 77 10 601 | 9/1977 | Germany . |
| 1 530 551 | 11/1978 | United Kingdom . |
| 2 070 178 | 9/1981 | United Kingdom . |

*Primary Examiner*—Michael C. Wimer

*Attorney, Agent, or Firm*—Burns, Doane, Swecker & Mathis, L.L.P.

[57] ABSTRACT

An indoor/outdoor antenna mounting enclosure that may be mounted either vertically or horizontally comprises a front shell and a rear shell fastened together to enclose an interior space for a printed circuit board, the shells each have a plurality of cooling fins oriented obliquely to a longitudinal axis of the enclosure. Each of the front and rear shells includes mounting bosses for two receive antennas and a transmit antenna, the transmit antenna mounting location separated by a predetermined longitudinal distance from the first and second receive antenna mounting locations. The mounting bosses allow the antennas to be oriented either with the longitudinal or transverse axis of the enclosure. Keying holes in the shells ensure that the receive and transmit antennas are mountable only in the designated mounting location in the correct orientation. In addition, the receive antenna mounting locations on the front shell are back to back with the receive antenna mounting locations on the rear shell to prevent interference between receive and transmit antennas.

26 Claims, 9 Drawing Sheets

TRANSMIT/RECEIVE ANTENNA MOUNTING ENCLOSURE

FIELD OF THE INVENTION

The invention relates to a mounting enclosure for transmit and receive antennas for radio communications systems, for example, cellular communications systems.

SUMMARY OF THE INVENTION

Antenna mounting enclosures for local cellular communications systems and for combined cable and radio cell systems must meet a number of structural and functional requirements. The enclosure provides a protective enclosure for a printed circuit board and the structure for externally supporting the receive and transmit antennas that connect to the printed circuit board. The mounting enclosure is mounted on a utility pole or a cable or cross piece carried on a pole, which typically subjects it to size restriction by local government regulations. In addition, the enclosure must be adaptable to mounting vertically or horizontally, as conditions permit, while ensuring the correct orientation of the antennas. Further, the removal and replacement of antennas on the enclosure must be facilitated for field repair or replacement. In addition, the installation of a new or replacement antennas must ensure the correct placement of receive and transmit antennas, that is, that installation of a receive antenna in a transmit antenna location must be prevented, and vice versa.

The present invention provides a mounting enclosure for receive and transmit antennas and a printed circuit board that solves these and other problems.

The mounting enclosure according to the invention includes means for mounting the enclosure with a long axis oriented in the vertical or the horizontal, and includes means for mounting antennas with correct vertical antenna orientation.

According to another aspect of the invention, the mounting enclosure includes means for ensuring that only the compatible type of antenna is mountable at the designated mounting locations, that is, that a transmit antenna may be mounted only at a transmit antenna location.

According to yet another aspect of the invention, the enclosure includes a plurality of cooling fins formed on the external front and rear faces, the fins being oriented obliquely to the long axis of the enclosure to provide good air flow for cooling when the enclosure is mounted either vertically or horizontally.

The enclosure according to the invention also provides an enclosure in which the receive and transmit antennas are mounted so that interference between the antennas is substantially prevented.

DETAILED DESCRIPTION

Figure 1:
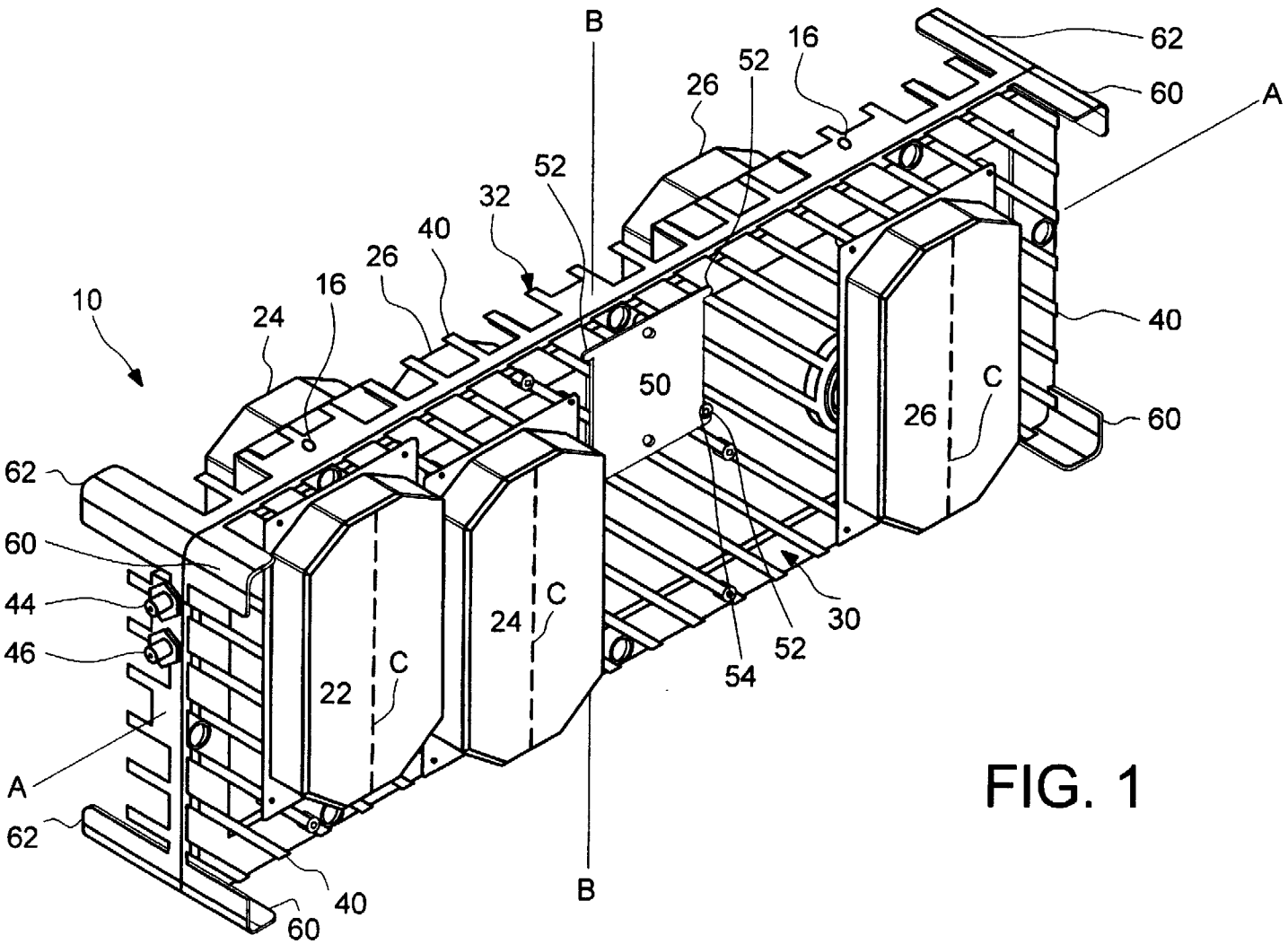
FIG. 1 is a perspective view of the front of a mounting enclosure in accordance with the invention showing a horizontal enclosure mounting arrangement.
Figure 2:
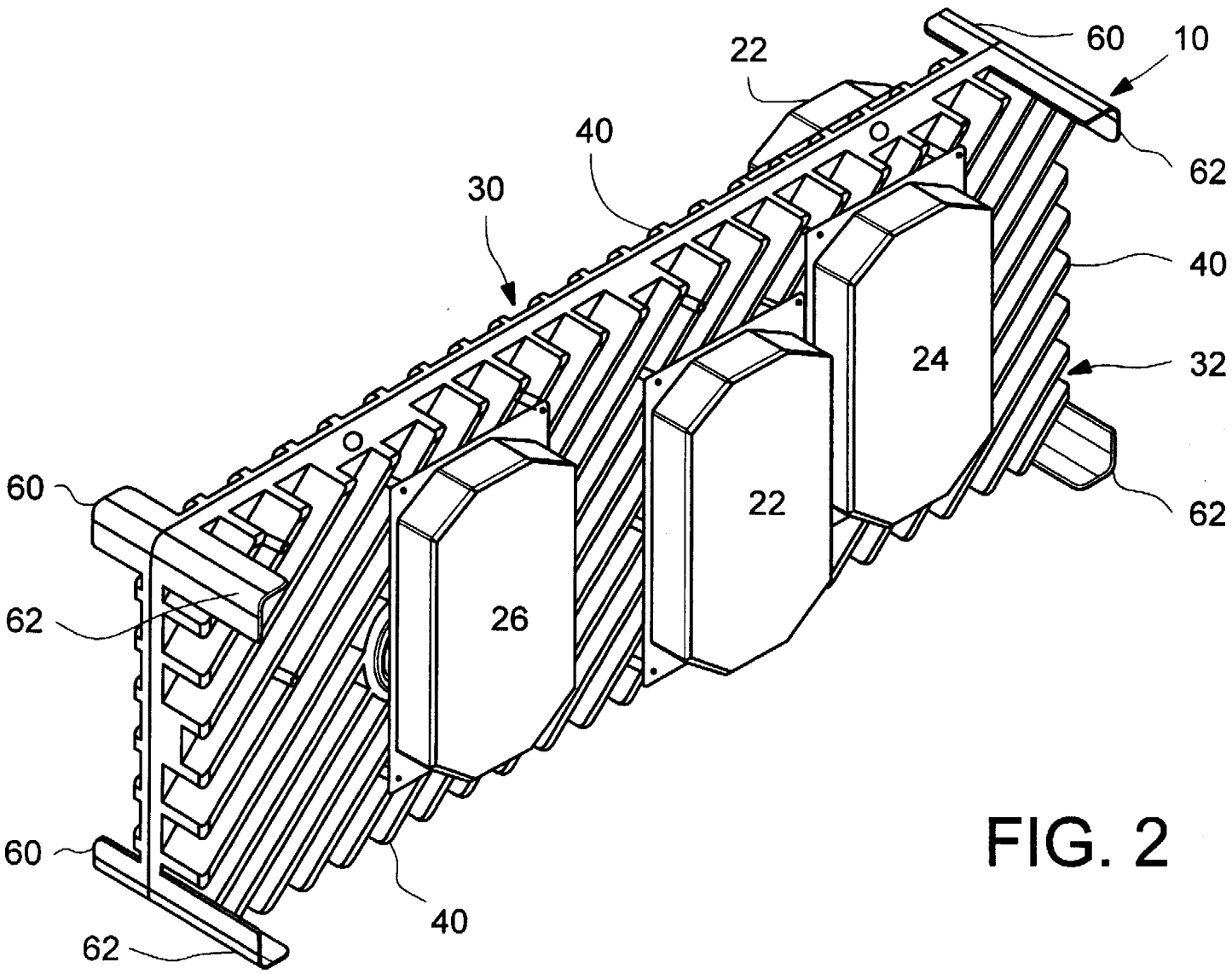
FIG. 2 is a perspective view of the rear of the mounting enclosure of FIG. 1.

An antenna mounting enclosure 10 according to the invention is illustrated in perspective view in FIG. 1 and FIG. 2. The FIGS. 1 and 2 show a mounting arrangement for receive antennas 22, 24 and transmit antennas 26 for a horizontal enclosure orientation. An alternative vertical enclosure orientation is described and illustrated below in connection with FIG. 6*a* and 6*b*. The mounting enclosure 10 includes a front shell 30 and a rear shell 32 fastened together to enclose an interior space (shown in the sectional view of FIG. 9). The mounting enclosure 10 is preferably rectangularly shaped and has a longitudinal axis A—A which is longer than a transverse axis B—B.

The mounting enclosure 10 may be mounted, for example, in a horizontal orientation on a cable or strand carried by a pole, or in a vertical orientation mounted to a utility pole or other structure. Fastening holes 16 are formed in the enclosure 10 for attaching a mounting bracket (not illustrated) to the enclosure 10. Local government regulations may restrict the space available on a utility pole to a maximum vertical distance. The width of the enclosure on the transverse axis B—B is given a size to comply with the maximum allowable distance, to permit horizontal mounting of the enclosure within allowable limits.

The antennas 22, 24, and 26 each have an antenna axis, indicated by the broken line C, which corresponds in the illustrated antennas to the longer dimension of the antenna unit. The antenna axis C must be vertically oriented when the enclosure 10 is mounted. As shown in the horizontal enclosure orientation of FIGS. 1 and 2, the antenna axes are parallel to the transverse axis B—B of the enclosure 10. As is further described below, the enclosure 10 according to the invention provides for mounting of the antennas in the correct vertical antenna axis orientation for either enclosure orientation.

The enclosure 10 is preferably formed of aluminum, by casting or machining, to provide an enclosure that is lightweight, strong, and protective from environmental contaminates such as water or moisture. Aluminum is heat conductive, which facilitates removing heat from the system's electronic components. Other materials that provide suitable protection and heat conduction may alternatively be employed. The shells 30, 32 are formed with grooves ridges on their mating edges (not illustrated), and a gasket is provided to seal the edges and prevent the ingress of water or moisture.

The enclosure 10 includes, on both the front 30 and rear 32 shells, a plurality of cooling fins 40. The cooling fins 40 are rib-like formations that project perpendicularly from the walls of the front 30 and rear 32 shells. The fins 40 are oriented obliquely to the longitudinal A—A and transverse B—B axes. The fins 40 are provided to help dissipate heat generated by the printed circuit board and power supply. The oblique orientation, preferably at 45° to the longitudinal axis A—A, ensures a flow of air over the cooling fins 40 in either of the horizontal or vertical enclosure orientations.

The rear shell 32 includes connector taps 44, 46 to connect, for example, with a power source and/or a cable connection with a customer in a cable cell system.

The enclosure 10 also includes a sliding door 50 covering an aperture on the front shell 30 to permit field access to the interior of the enclosure without the necessity of removing the enclosure from its mounting and disassembling the shells. The door 50 is formed as a flat panel with legs 52 extending from each of the four corners. The door 50 is captured between two pins 54 for sliding movement, the legs 52 providing stops to limit movement of the door.

Figure 3:
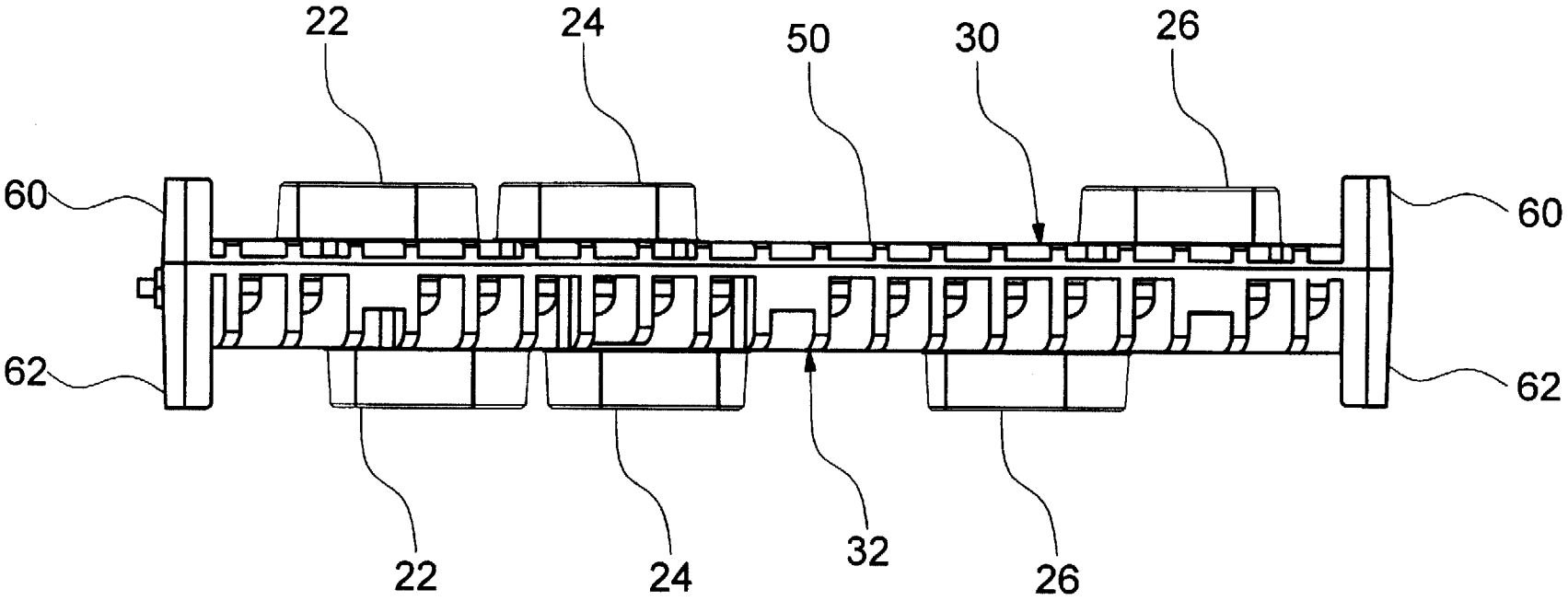
FIG. 3 is a top view of the mounting enclosure of FIG. 1.
Figure 4:
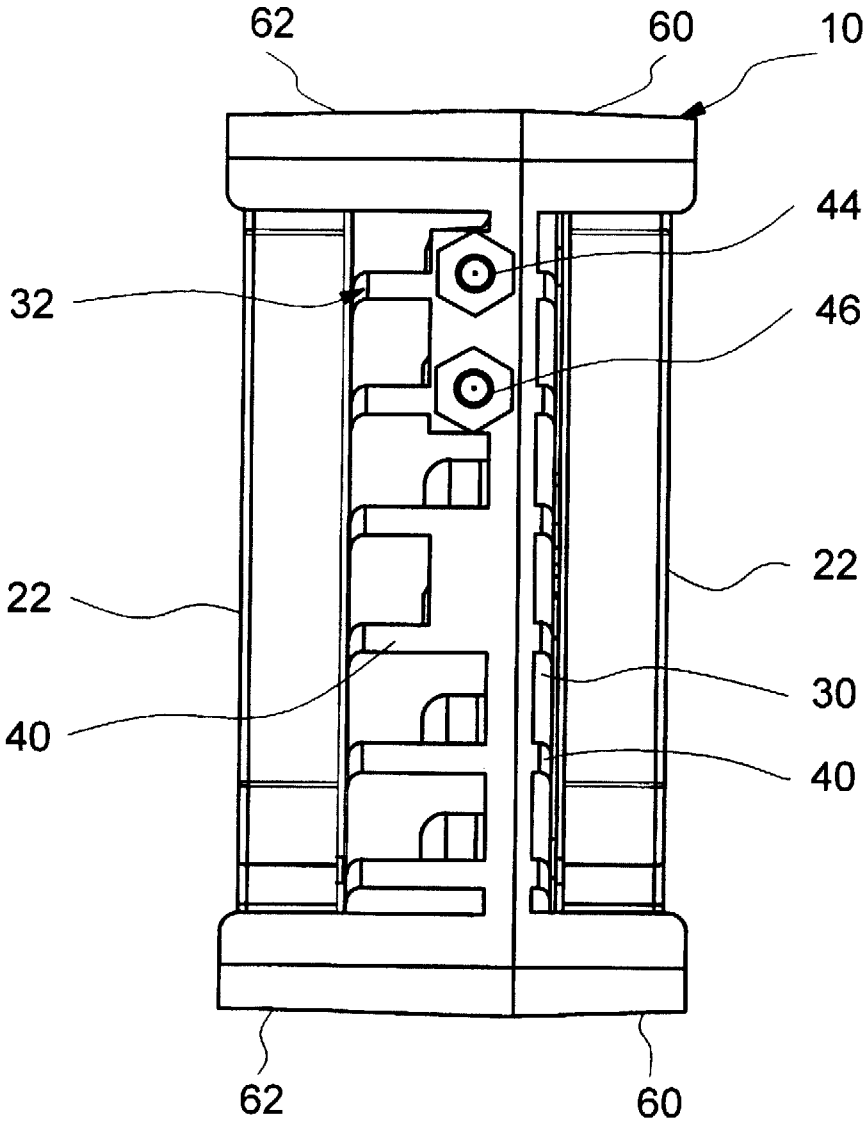
FIG. 4 is an end view of the mounting enclosure of FIG. 1.

Supporting feet 60 are formed on the front shell 30 and supporting feet 62 are formed on the rear shell 32. When the shells 30, 32 are assembled as shown in FIG. 1, the feet 60, 62 form platforms that allow the enclosure 10 to stand horizontally on the long side, as shown, or as may be understood, vertically on the short side. As may be seen in FIG. 3, the feet 60, 62 are made sufficiently long to accommodate the thickness of the antennas 22, 24, and 26, to allow the enclosure 10 to stand on either the front shell 30 or the rear shell 32 without risk of damage to the antennas. The feet 60, 62 shown in the figures are formed as curved projections at the comers of the shells 30, 32. Alternatively, the feet may be formed as enlargements of the comer cooling fins of the shells 30, 32.

Figure 5A:
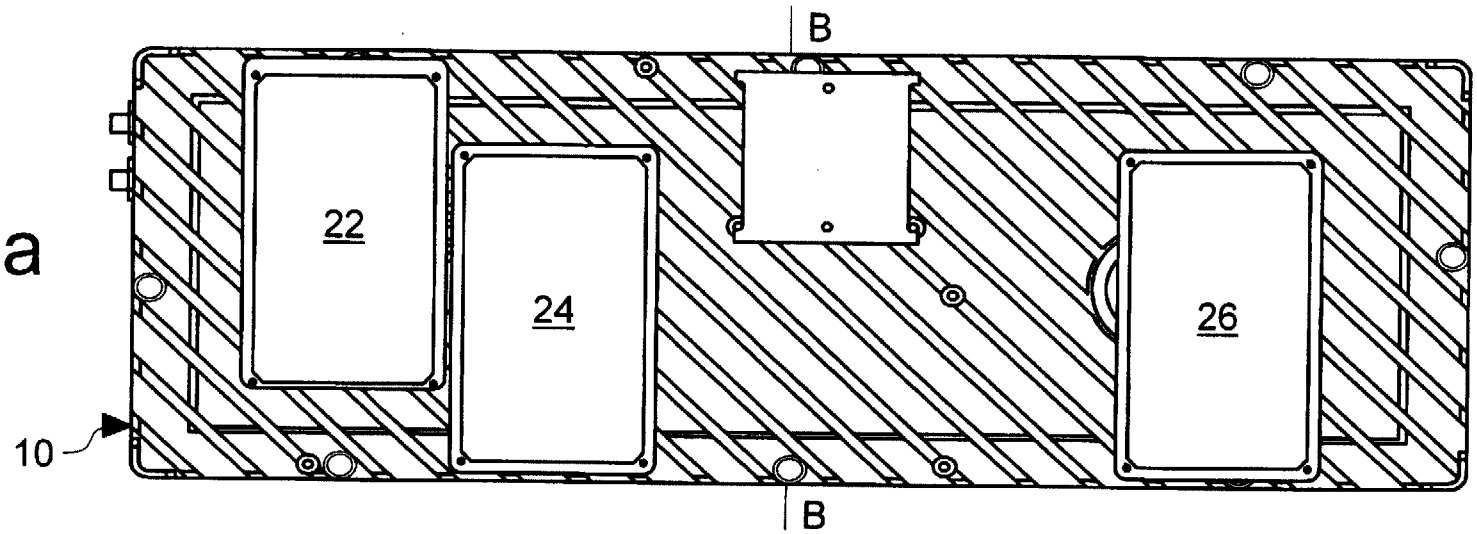
FIG. 5*a* is a front view of the enclosure showing a horizontal enclosure mounting arrangement.
Figure 5B:
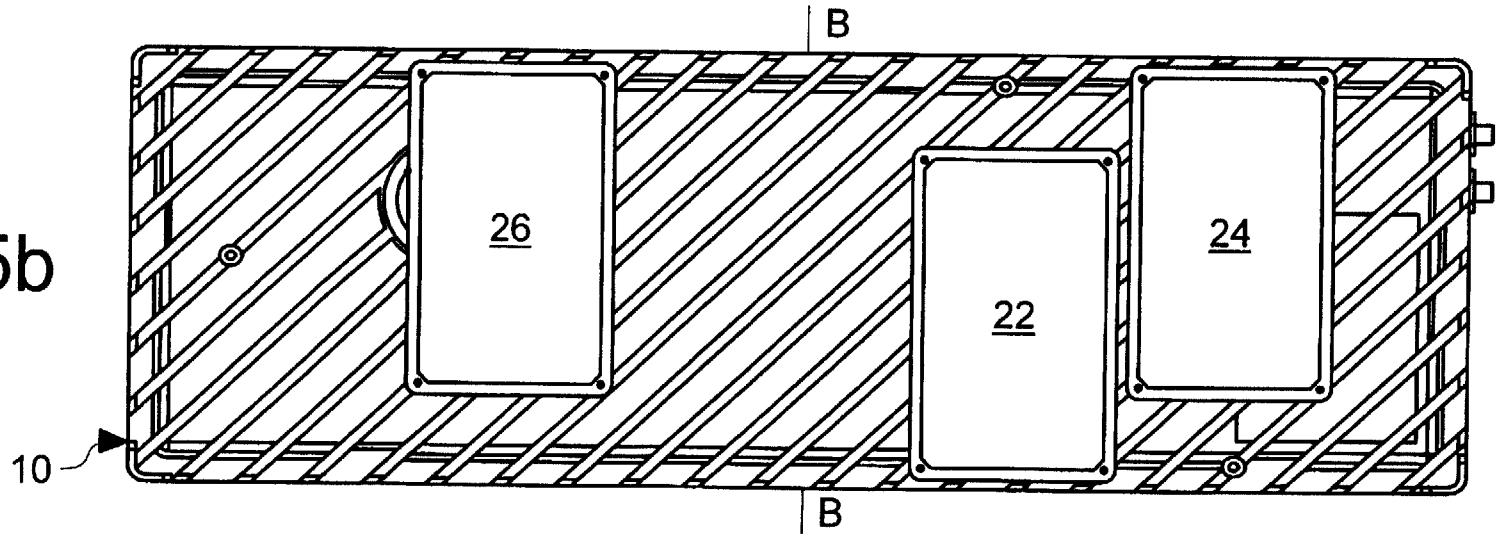
FIG. 5*b* is a rear view of the enclosure of FIG. 5*a;*
Figure 6A:
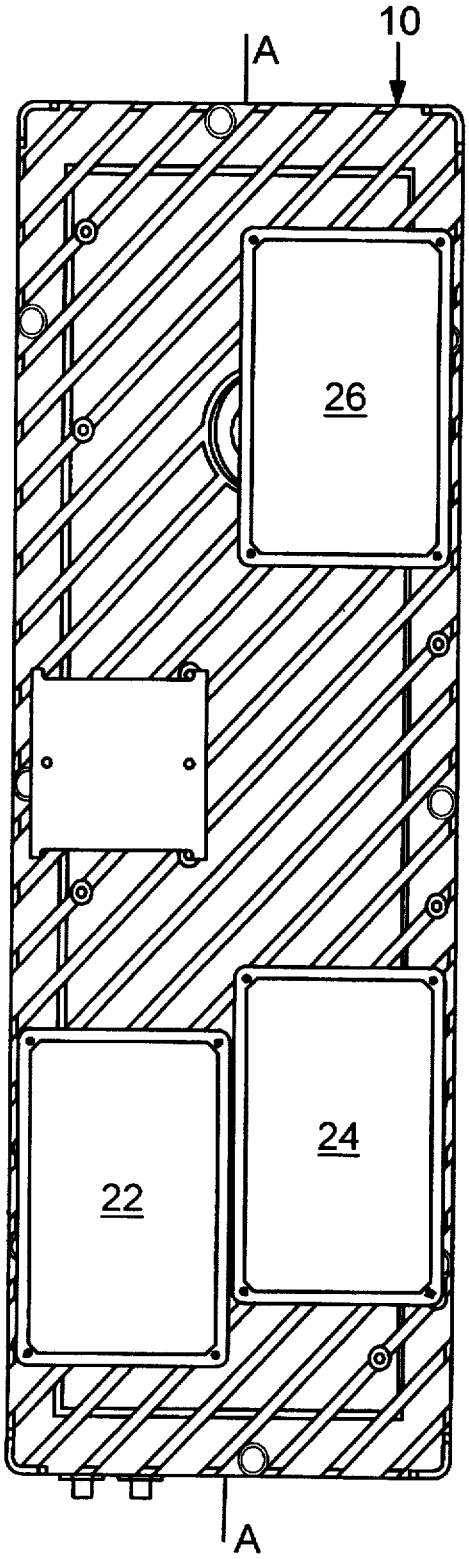
FIG. 6*a* is a front view of the enclosure showing a vertical enclosure mounting arrangement.
Figure 6B:
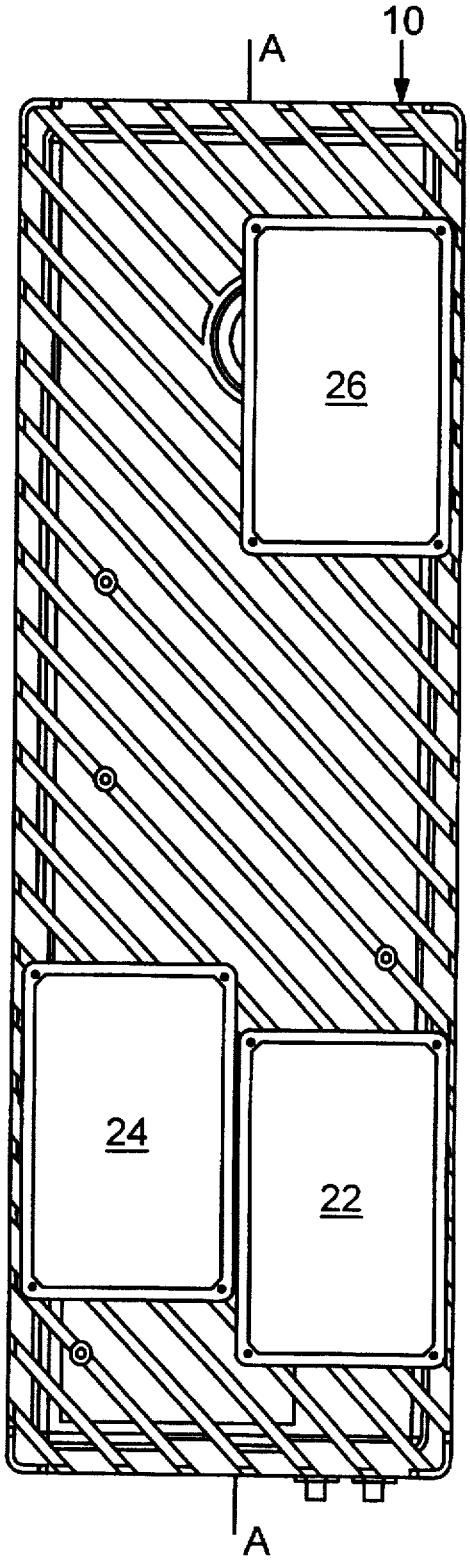
FIG. 6*b* is a rear view of the enclosure of FIG. 6*a;*

FIGS. 5*a* and 5*b* illustrate a front and rear view of the enclosure 10 with horizontal mounting orientation. The antennas 22, 24 and 26 are, as explained above, oriented with the respective axes C aligned on the transverse axis B—B of the enclosure 10. FIGS. 6*a* and 6*b* illustrate the enclosure 10 in vertical mounting orientation with the antennas 22, 24 and 26 correspondingly oriented on the longitudinal axis A—A of the enclosure 10. As may be understood from the FIGS. 5*a*, 5*b* and 6*a*, 6*b*, the transmit antennas 26 are separated from the receive antennas 22, 24 by a predetermined space. As described above, the spacing is provided to prevent interference between transmit and receive antennas. In addition, the respective transmit antennas 26 and receive antennas 22, 24 on each of the front 30 and rear 32 shells are arranged back to back across that enclosure, that is, in opposition across the interior space. This also helps insure that the various antennas do not interfere with each other.

Figure 9:
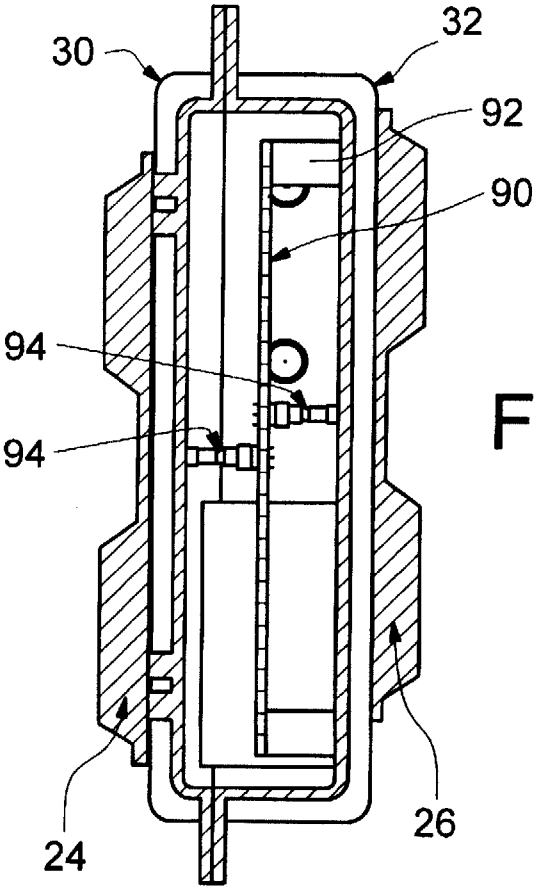
FIG. 9 is a section view of the enclosure showing the connections of the antennas with a printed circuit board mounted therein.

In FIG. 9, a cross section of the enclosure 10 shows antennas 24 and 26 connected to the printed circuit board 90 with connectors 92. The connectors 92 are standard type coaxial connectors with spacers or adapters to provide any needed length. The printed circuit board 90 is mounted on studs 94 in the rear shell 32. The printed circuit board 90 is not rigidly attached to the studs 94, but is allowed some float to compensate for expansion and contraction of the connectors 92 due to heating and cooling during use.

Figure 7:
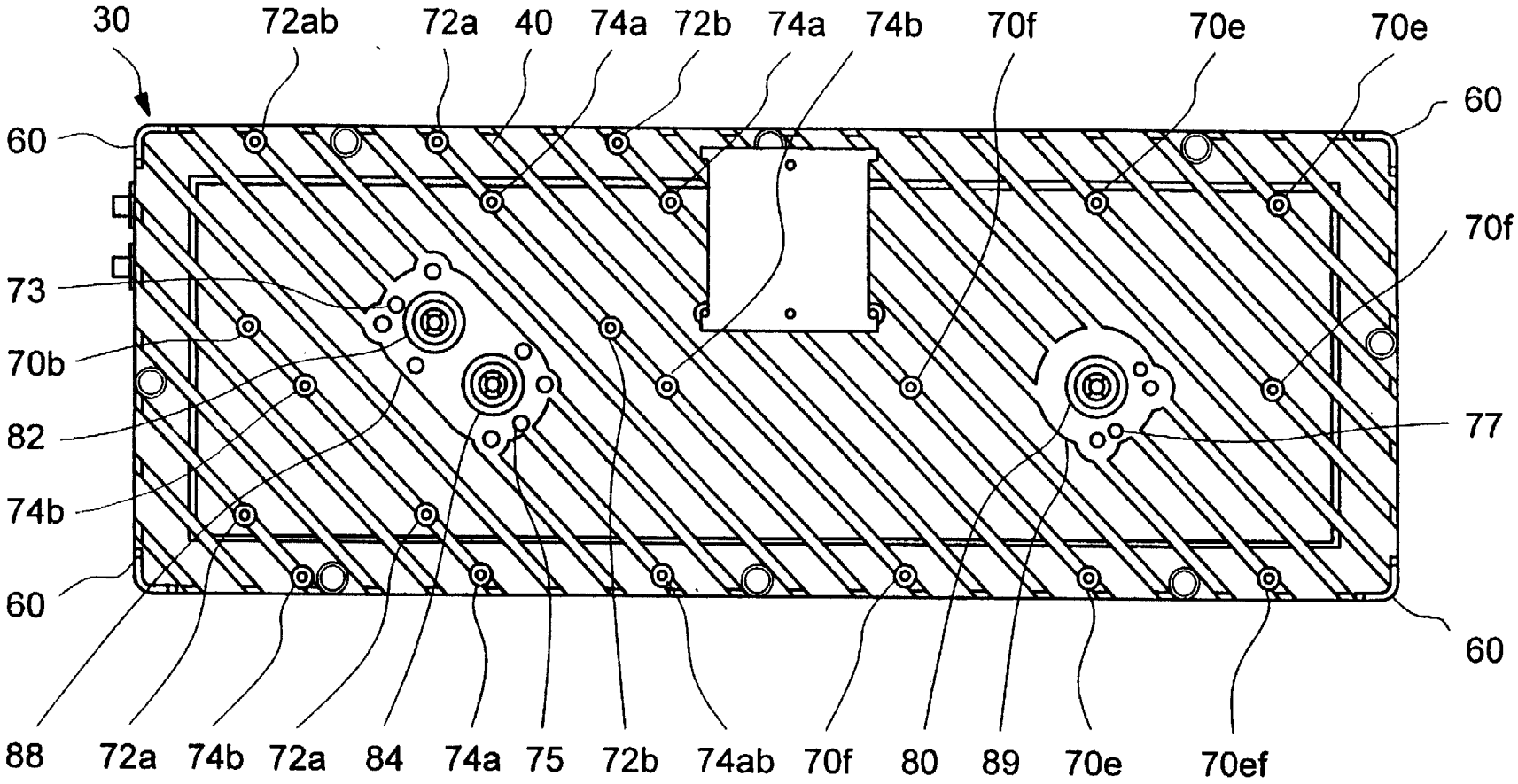
FIG. 7 is a front view of the enclosure according to the invention with the antennas removed.

FIG. 7 illustrates a front view of the front shell 30 with the antennas removed. The antennas are mounted to the enclosure with fasteners (not shown) screwed into a selected one of groups of threaded bosses 72*a–b*, 74*a–b*, and 70*e–f* formed on each of the shells. The following description of mounting and connecting means for the antennas for the front shell 30 is understood to apply as well to the rear shell 32. The groups of bosses 72*a–b*, 74*a–b*, and 70*e–f* are disposed on the shell face each in relation to one of the access holes 82, 84 and 80 to permit each of the antennas to connect with the printed circuit board in the enclosure 10. The groups of bosses 72*a–b*, 74*a–b*, and 70*e–f* are arranged to define a specific mounting location for a particular receive 22, 24 or transmit antenna 26. In addition, each group of bosses defines mounting locations for selectively mounting an antenna in either the horizontal or vertical enclosure mounting orientation.

The individual bosses are formed in the cooling fins 40, which creates virtually no disruption of cooling air flow between the fins, and simplifies the manufacture of the shell.

Referring to the bosses 72*a* and 72*b*, an antenna mounting location for the antenna 22 is defined. The bosses 72*a* define a mounting location for horizontal enclosure mounting orientation, and the bosses 72*b* define a mounting location for vertical enclosure mounting orientation. The bosses 72*a* and the bosses 72*b* both have the same positional relationship with the connector access hole 82. The boss 72*ab* is used in both orientations and helps simplify the design of the shell face. As may be seen, the groups of bosses 74*a*, 74*b* and 70*e*, 70*f* are similarly disposed to define horizontal and vertical orientation mounting locations at the access holes 84 and 80, respectively.

The access holes 82 and 84 are formed on a first collar 88 and the access hole 80 is formed on a second collar 89, spaced from the first collar 88. There are two types of receive antenna, which are unique and not interchangeable. Of course, the receive and transmit antennas are also not interchangeable. The collars 88 and 89 include mating means to ensure that only the correct type of antenna is mounted at the designated mounting location. According to the preferred embodiment, groups of keying holes 73, 75 and 77 are arranged on the collars for mating with corresponding keying pins provided on the antennas. Each of the groups of keying holes 73, 75, and 77 is arranged in a different pattern. The collar 88, 89 surfaces, therefore, will reject an antenna with an incompatible pin arrangement, thus ensuring exclusive mounting of the designated antenna.

Figure 8C:
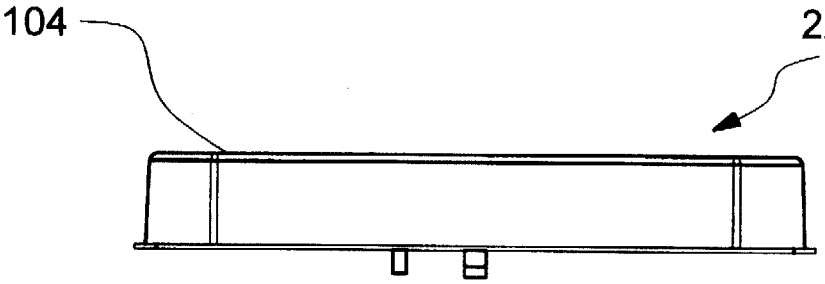
FIG. 8*c* is a side view of the antenna of FIG. 8*a;*
Figure 8A:
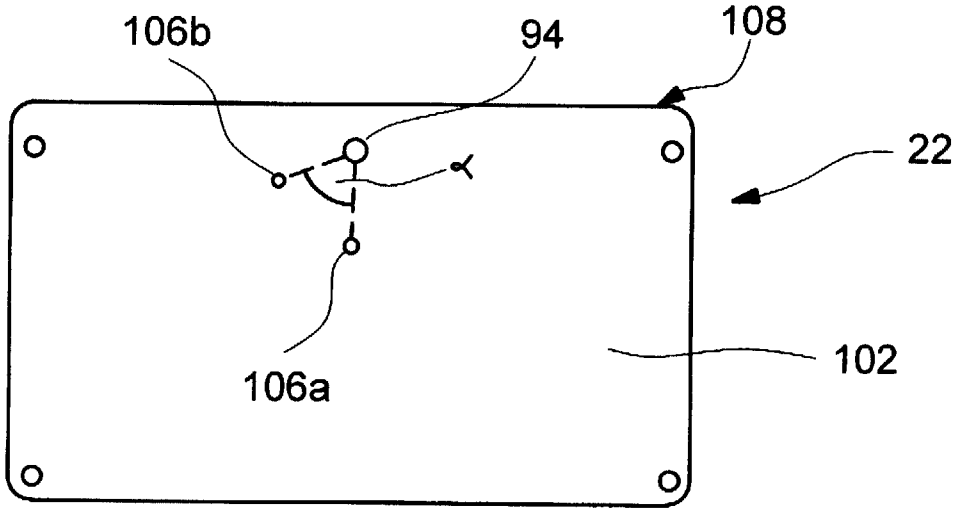
FIG. 8*a* is a bottom view of antenna showing a base plate.
Figure 8B:
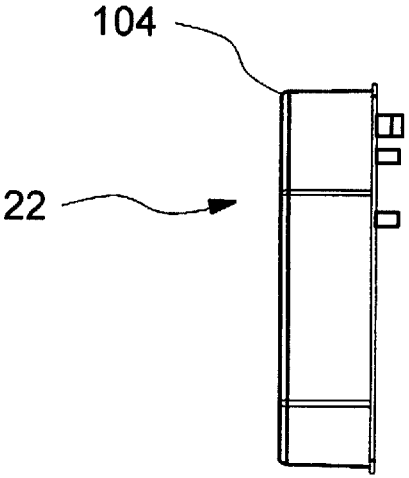
FIG. 8*b* is an end view of the antenna of FIG. 8*a;*

FIGS. 8*a*, 8*b*, and 8*c* illustrate an antenna 22 in three views. The antenna 22 includes a base plate 102 and a cover 104. The base plate 102 carries keying pins 106*a*, *b* and the connector 94. The connector 94 is located at the same base plate position in all the antennas. As seen in FIGS. 80*b* and 8*c*, the pins 106 and connector 94 extend from the base plate 102 to engage the keying holes and the connector access holes in the enclosure 10.

Each keying pin group comprises two pins 106 positioned relative to the connector 94. One pin 106*a* is positioned to define with the connector 94 a first line perpendicular to the edge 108 of the base plate adjacent to the connector 94. This pin position 106*a* is the same for all antennas, which simplifies manufacture. The second pin 106*b* is positioned at a predetermined distance from the connector 94 and to define with the connector 94 a second line at a predetermined angle $\alpha$ from the first line. For each type of antenna, the relative position of the second pin is unique, which may include the distance from the connector and the angle at which the defined line is disposed. The corresponding key holes in the collar 88 of the enclosure 10 are positioned with a compatible relationship to the access hole 82. As may be seen in FIG. 7, two sets of keying holes are provided at each of the access holes 82, 84 and 80. The two sets are identically arranged, with one set positioned for each of the vertical and horizontal enclosure mounting orientations.

To simplify manufacturing, a single base plate 102 having holes for all of the alternative antenna pin arrangements may be made, and the plate for a particular antenna completed by placing the second pin in the appropriate hole. The keying means may be formed by other than the described key holes and pins, for example, by using uniquely or differently shaped pins, or other suitable rejection arrangements.

Figure 10A:
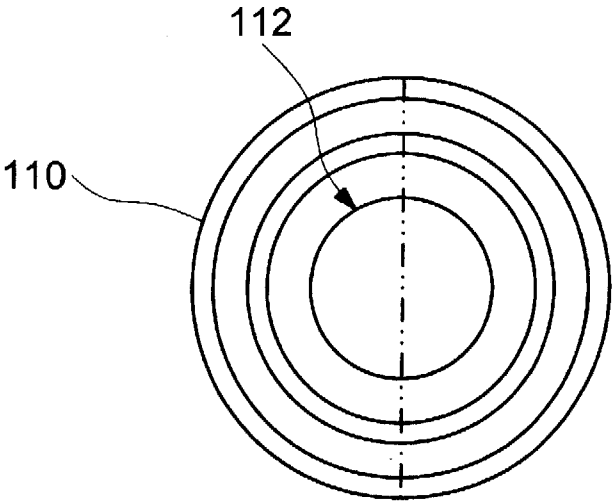
FIG. 10*a* is a top view of a connector access seal.
Figure 10B:
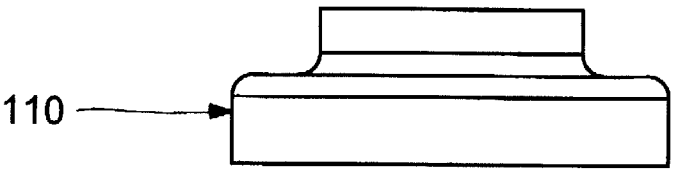
FIG. 10*b* is a side view of the connector access seal of FIG. 10*a*.

FIGS. 10*a* and 10*b* illustrate a sealing grommet 110 that is press fit in each of the access holes 82, 84, and 80 to prevent water or moisture from entering the interior space of the enclosure 10. The grommet 110 includes a central hole 112 through which the connector 94 is inserted. The grommet 110 is formed from an elastomeric material, and resiliently abuts the base plate 102 of the antennas to help form a seal. In addition, the grommets 110 readily adapt to small differences in connector length arising from manufacturing tolerances.

The invention has been described in terms of preferred features and embodiments, however, those skilled in the art will appreciate that the invention may be practiced with equivalents for the specific elements described without departing from spirit and scope of the invention as defined by the following claims.

What is claimed is:

1. An antenna mounting enclosure comprising:

a front shell and a rear shell, each shell having a longitudinal axis and a transverse axis, the front shell and rear shell being fastenable together to enclose an interior space, means formed in one of the front and rear shells for mounting a printed circuit board in the interior space, the front shell having a front face, means for mounting a receive antenna and a transmit antenna to the front face, said means including a plurality of mounting bosses, a first plurality of bosses defining at least one receive antenna mounting location and a second plurality of bosses defining a transmit antenna mounting location, the transmit antenna mounting location separated by a longitudinal predetermined distance from the receive antenna mounting location, the first plurality of bosses defining both longitudinally and transversely oriented receive antenna mounting locations for mounting a receive antenna selectively aligned with one of the longitudinal axis and transverse axis, and the second plurality of bosses defining both longitudinally and transversely oriented transmit antenna mounting locations for mounting a transmit antenna selectively aligned with one of the longitudinal axis and transverse axis, and first mating means at the at least one receive antenna location to exclusively mate with a receive antenna mating means, said first mating means comprising first keying hole means in a first pattern at the at least one receive antenna location to mate with receive antenna mating means including keying pin means on a receive antenna and second mating means at the transmit antenna mounting location to exclusively mate with a transmit antenna mating means, said second mating means comprising second keying hole means in a second pattern at the transmit antenna mounting location to mate with transmit antenna mating means including keying pin means on a transmit antenna the first pattern and second pattern being mutually different, the front face including access holes communicating with the interior located at the at least one receive antenna mounting location and at the transmit antenna mounting location.

2. The mounting enclosure as claimed in claim 1, further comprising a plurality of fins formed on the front shell and projecting therefrom, the fins being oriented obliquely to the longitudinal axis, and wherein each boss is disposed on a fin.

3. The mounting enclosure as claimed in claim 1, wherein the first keying hole means includes horizontal orientation keying holes and vertical orientation keying holes for mounting a receive antenna selectively aligned with one of the longitudinal axis and transverse axis, and the second keying hole means includes horizontal orientation keying holes and vertical orientation keying holes for mounting a transmit antenna selectively aligned with one of the longitudinal axis and transverse axis.

4. The mounting enclosure as claimed in claim 3, wherein the horizontal orientation keying holes and vertical keying holes of the first keying holes means each form a group arranged in the first pattern about the access hole at the receive antenna mounting location and oriented at 90° relative to one another, and the horizontal orientation keying holes and vertical keying holes of the second keying holes means each form a group arranged in the second pattern about the access hole at the transmit antenna mounting location and oriented at 90° relative to one another.

5. The mounting enclosure as claimed in claim 1, further comprising a third plurality of mounting bosses, each boss disposed on a fin, defining a second receive antenna mounting location adjacent the at least one receive antenna mounting location, and second receive antenna mating means at the second receive antenna mounting location to exclusively mate with a second receive antenna, and the front face including a third access hole communicating with the interior located at the second receive antenna, wherein the third plurality of bosses define both longitudinally and transversely oriented second receive antenna mounting locations for mounting the second receive antenna with the mounting axis aligned with one of the longitudinal axis and transverse axis.

6. The mounting enclosure as claimed in claim 5, wherein the second receive antenna mating means comprises a third keying hole means arranged in a third pattern at the second receive antenna location to mate with keying pin means on a second receive antenna.

7. The mounting enclosure as claimed in claim 6, wherein the third keying hole means includes horizontal orientation keying holes and vertical orientation keying holes for mounting a second receive antenna selectively aligned with one of the longitudinal axis and transverse axis.

8. The mounting enclosure as claimed in claim 7, wherein the horizontal orientation keying holes and vertical keying holes of the third keying holes means each form a group arranged in the third pattern about an access hole at the second receive antenna mounting location and oriented at 90° relative to one another.

9. The mounting enclosure as claimed in claim 1, comprising seal means disposed in each of the access holes.

10. The mounting enclosure as claimed in claim 1, wherein the rear shell has a face, and the rear shell face includes means for mounting a receive antenna and a transmit antenna, said means including a plurality of mounting bosses, a first plurality of bosses defining at least one receive antenna mounting location and a second plurality of bosses defining a transmit antenna mounting location, the transmit antenna mounting location separated by a predetermined distance from the receive antenna mounting location, wherein the first plurality of bosses define longitudinally and transversely oriented receive antenna mounting locations for mounting a receive antenna selectively aligned with one of the longitudinal axis and transverse axis, and the second plurality of bosses define longitudinally and transversely oriented transmit antenna mounting locations for mounting a transmit antenna selectively aligned with one of the longitudinal axis and transverse axis, a first mating means at the at least one receive antenna location for mating exclusively with a receive antenna and second mating means at the transmit antenna mounting location to mate exclusively with a transmit antenna, the first pattern and second pattern being mutually different, and the rear face including access holes communicating with the interior located at the at least one receive antenna mounting location and at the transmit antenna mounting location.

11. The mounting enclosure as claimed in claim 10, wherein the rear shell has a plurality of fins formed on its face and projecting therefrom, the fins being oriented obliquely to the longitudinal axis, and each boss is disposed on a fin.

12. The mounting enclosure as claimed in claim 10, wherein said first mating means comprises first keying hole means in a first pattern at the at least one receive antenna location to mate with receive antenna mating means including keying pin means on a receive antenna and the second mating means comprises second keying hole means in a second pattern at the transmit antenna mounting location to mate with transmit antenna mating means including keying pin means on a transmit antenna, the first pattern and second pattern being mutually different.

13. The mounting enclosure as claimed in claim 12, wherein the first keying hole means includes horizontal orientation keying holes and vertical orientation keying holes for mounting a receive antenna selectively aligned with one of the longitudinal axis and transverse axis, and the second keying hole means includes horizontal orientation keying holes and vertical orientation keying holes for mounting a transmit antenna selectively aligned with one of the longitudinal axis and transverse axis.

14. The mounting enclosure as claimed in claim 13, wherein the horizontal orientation keying holes and vertical keying holes of the first keying holes means each form a group arranged in the first pattern about the access hole at the receive antenna mounting location and oriented at 90° relative to one another, and the horizontal orientation keying holes and vertical keying holes of the second keying holes means each form a group arranged in the second pattern about the access hole at the transmit antenna mounting location and oriented at 90° relative to one another.

15. The mounting enclosure as claimed in claim 10, wherein the receive antenna mounting locations of the front shell and the rear shell are located in opposition relative to the interior space, and the transmit mounting locations of the front shell and the rear shell are located in opposition relative to the interior space.

16. The mounting enclosure as claimed in claim 10, wherein the rear face further comprises a third plurality of mounting bosses defining a second receive antenna mounting location adjacent the at least one receive antenna mounting location, and second receive antenna mating means at the second receive antenna mounting location to exclusively mate with a second receive antenna, and the rear face including a third access hole communicating with the interior located at the second receive antenna, wherein the third plurality of bosses define both longitudinally and transversely oriented second receive antenna mounting locations for mounting the second receive antenna with the mounting axis aligned with one of the longitudinal axis and transverse axis.

17. The mounting enclosure as claimed in claim 16, wherein the second receive antenna mating means includes horizontal orientation keying holes and vertical orientation keying holes for mounting a second receive antenna selectively aligned with one of the longitudinal axis and transverse axis.

18. The mounting enclosure as claimed in claim 17, wherein the horizontal orientation keying holes and vertical keying holes each form a group arranged in a third pattern about an access hole at the second receive antenna mounting location and oriented at 90° relative to one another.

19. The mounting enclosure as claimed in claim 10, comprising seal means disposed in each of the rear face access holes.

20. An outdoor antenna mounting enclosure comprising:

a front shell and a rear shell, each shell having a longitudinal axis and a transverse axis, the front shell and rear shell being fastened together to enclose an interior space, means formed in one of the front and rear shells for mounting a printed circuit board in the interior space, the front shell having a front face and a plurality of fins formed thereon and projecting therefrom, the fins being oriented obliquely to the longitudinal axis, the rear shell having a rear face and a plurality of fins formed thereon and projecting therefrom, the fins being oriented obliquely to the longitudinal axis, means for mounting two receive antennas and a transmit antenna to the front face, and means for mounting two receive antennas and a transmit antenna to the rear face, said means on each of the front face and rear face including a plurality of mounting bosses, each boss disposed on a fin, a first plurality of bosses defining a first receive antenna mounting location, a second plurality of bosses defining an adjacent second receive antenna mounting location and a third plurality of bosses forming a transmit antenna mounting location, the transmit antenna mounting location separated by a predetermined longitudinal distance from the first and second receive antenna mounting locations, the first and second plurality of bosses define both longitudinally and transversely oriented receive antenna mounting locations for mounting a first and a second receive antenna selectably aligned with one of the longitudinal axis and transverse axis, and the third plurality of bosses define longitudinally and transversely oriented transmit antenna mounting locations for mounting a transmit antenna selectably aligned with one of the longitudinal axis and transverse axis and first mating means at the first receive antenna location for mating exclusively with a first receive antenna, second mating means at a second receive antenna location for mating exclusively with a second receive antenna, and third mating means at the transmit antenna mounting location for mating exclusively with a transmit antenna, wherein the front face and rear face including access holes communicating with the interior located at the first and second receive antenna mounting locations and at the transmit antenna mounting location.

21. The mounting enclosure as claimed in claim 20, wherein the first and second receive antenna mounting locations of the front shell are located in opposition across the interior space to the first and second receive antenna mounting locations of the rear shell, and the transmit mounting location of the front shell are located in opposition across the interior space to the transmit antenna mounting location of the rear shell.

22. The mounting enclosure as claimed in claim 20, further comprising, for each of the front and rear shells, a first and second receive antenna and a transmit antenna, each have a mounting axis.

23. The mounting enclosure as claimed in claim 20, wherein the first mating means comprises first keying hole means in a first pattern at the first receive antenna location for mating with keying pin means on a first receive antenna, the second mating means comprises second keying hole means in a second pattern at the second receive antenna location for mating with keying pin means on a second receive antenna, and the third mating means comprises third keying hole means in a third pattern at the transmit antenna mounting location to mate with keying pin means on a transmit antenna, the first, second and third patterns being mutually different.

24. The mounting enclosure as claimed in claim 23, wherein the first keying hole means includes horizontal orientation keying holes and vertical orientation keying holes for mounting a receive antenna selectively aligned with one of the longitudinal axis and transverse axis, and the second keying hole means includes horizontal orientation keying holes and vertical orientation keying holes for mounting a transmit antenna selectively aligned with one of the longitudinal axis and transverse axis.

25. The mounting enclosure as claimed in claim 24, wherein the horizontal orientation keying holes and vertical keying holes of the first keying holes means each form a group arranged in the first pattern about the access hole at the receive antenna mounting location and mutually oriented at 90°, and the horizontal orientation keying holes and vertical keying holes of the second keying holes means each form a group arranged in the second pattern about the access hole at the transmit antenna mounting location and mutually oriented at 90°.

26. The mounting enclosure as claimed in claim 20, wherein the front and rear shells include supporting feet extending substantially perpendicularly from the front and rear shells a distance greater than a distance antennas extend from the shells.

* * * * *